United States Patent [19]

Ushio et al.

[11] Patent Number: 5,041,340

[45] Date of Patent: Aug. 20, 1991

[54] FIBER-REINFORCED LIGHT ALLOY MEMBER EXCELLENT IN HEAT CONDUCTIVITY AND SLIDING PROPERTIES

[75] Inventors: Hideaki Ushio; Tadayoshi Hayashi; Kazuo Shibata, all of Saitama, Japan

[73] Assignee: Honda Giken Kogyo Kabushiki Kaisha, Tokyo, Japan

[21] Appl. No.: 241,014

[22] Filed: Sep. 2, 1988

[30] Foreign Application Priority Data

Sep. 3, 1987 [JP] Japan ..... 62-220999

[51] Int. Cl.[5] ..... C22C 1/09; C22C 21/00

[52] U.S. Cl. ..... 428/614

[58] Field of Search ..... 428/614

[56] References Cited

U.S. PATENT DOCUMENTS

| | | | |
|---|---|---|---|
| 3,885,959 | 5/1975 | Badia et al. | 428/627 |
| 4,450,207 | 5/1984 | Donomoto et al. | 428/614 |
| 4,590,132 | 5/1986 | Dohnomoto et al. | 428/614 |
| 4,757,790 | 7/1988 | Ushio et al. | 123/193 C |

FOREIGN PATENT DOCUMENTS

| | | | |
|---|---|---|---|
| 0182034 | 5/1986 | European Pat. Off. | 428/614 |
| 51-41175 | 4/1976 | Japan | 428/614 |
| 58-81948 | 5/1983 | Japan | 428/614 |
| 58-147532 | 9/1983 | Japan | 428/614 |
| 59-173234 | 10/1984 | Japan | 428/614 |
| 60-9838 | 1/1985 | Japan | 428/614 |
| 60-82645 | 5/1985 | Japan | 428/614 |
| 62-64467 | 3/1987 | Japan | 428/614 |
| 62-89833 | 4/1987 | Japan | 428/614 |
| 1207538 | 10/1970 | United Kingdom | 428/614 |
| 2183785 | 6/1987 | United Kingdom | 428/614 |
| 2193786 | 2/1988 | United Kingdom | 428/614 |

*Primary Examiner*—R. Dean
*Assistant Examiner*—David Schumaker
*Attorney, Agent, or Firm*—Lyon & Lyon

[57] ABSTRACT

A fiber-reinforced light alloy member excellent in heat conductivity and sliding properties which contains a mixed fiber uniformly dispersed in a light alloy matrix, the mixed fiber including of a ceramic fiber having a fiber volume fraction of 4 to 60% and a carbon fiber having a fiber volume fraction of 0.5 to 10%, and is produced through a thermal treatment at a heating temperature of 400° to 550° C.

2 Claims, 6 Drawing Sheets

FIBER-REINFORCED LIGHT ALLOY MEMBER EXCELLENT IN HEAT CONDUCTIVITY AND SLIDING PROPERTIES

BACKGROUND OF THE INVENTION

1. Field of the Invention

The present invention relates to a fiber-reinforced light alloy member excellent in heat conductivity and sliding properties.

2. Description of the Prior Art

There is conventionally known a light alloy member which is fiber-reinfored with a ceramic fiber having a fiber volume fraction of 4 to 60% (see Japanese Patent Application Laid-open No. 109903/75).

The ceramic fibers which have been used include an alumina-based fiber, a silicon carbonate whisker and the like. However, the ceramic fiber has a lower heat conductivity and for example, the almina fiber has a heat conductivity of 0.07 cal/cm.s.° C., and the silicon carbonate whisker has a heat conductivity of 0.05 cal/cm.s.° C. Consequently, there is a problem that the heat conductivity of the resultant light alloy member is reduced as the fiber volume fraction of the ceramic fiber increases. despite a higher heat conductivity of a light alloy matrix.

There is also a problem that when a light alloy member is applied as a slide member, sliding properties such as resistance to scratch and seizure are inferior, because the ceramic fiber itself has no lubricity.

SUMMARY OF THE INVENTION

With the foregoing in view, it is an object of the present invention is to provide a fiber-reinforced light alloy member of the type described above, which has a higher heat conductivity and good sliding properties.

To accomplish the above object, according to the present invention, there is provided a fiber-reinforced light alloy member excellent in heat conductivity and sliding properties, which contains a mixed fiber uniformly dispersed in a light alloy matrix, the mixed fiber including of a ceramic fiber having a fiber volume fraction of 4 to 60% and a carbon fiber having a fiber volume fraction of 0.5 to 10%, and which is produce through a thermal treatment at a heating temperature of 400° to 550° C.

The carbon fiber has a higher heat conductivity, but has a poor wettability with a light alloy matrix such as an aluminum alloy, a magnesium alloy and the like. The contact of the carbon fiber with the light alloy matrix at the interface therebetween is inferior and as a result, there is a possibility to bring about a situation that the higher heat conductivity of the carbon fiber cannot be fully put to a practical use.

According to the present invention, the fiber volume fraction of the carbon fiber is set at a smaller level in a range of 0.5 to 10% as described above, so that the carbon fiber is uniformly dispersed in the light alloy matrix. Therefore, the light alloy matrix is brought into a satisfactorily close contact with the carbon fiber by a pressing force acting on the light alloy matrix for a short time during casting of a light alloy member, and the carbon fiber is strongly embraced into the light alloy matrix during solidificational shrinkage.

Further, the above-described thermal treatment causes an extremely thin layer of reaction product to be formed at the interface between the light alloy matrix and the carbon fiber.

As a result, a good contact of the carbon fiber and the light alloy matrix at the interface therebetween can be achieved to provide a light alloy member having a good heat conductivity which results from fully putting the higher heat conductivity of the carbon fiber to a practical use.

Further, if the carbon fiber is uniformly dispersed in the light alloy matrix, the sliding properties of a resultant light alloy member can be improved, because the carbon fiber has a lubricating power.

The above and other objects, features and advantages of the invention will become apparent from reading of the following description of the preferred embodiment, taken in conjunction with the accompanying drawings.

BRIEF DESCRIPTION OF THE DRAWINGS

FIG. 1 to 3 illustrate a cylinder block for an internal combustion engine, wherein FIG. 1 is a plan view of the cylinder block;

FIG. 2 is a sectional view taken a line II—II in FIG. 1; and

FIG. 3 is a sectional view taken along a line III—III in FIG. 2;

DESCRIPTION OF THE PREFERRED EMBODIMENTS

Figure 1:
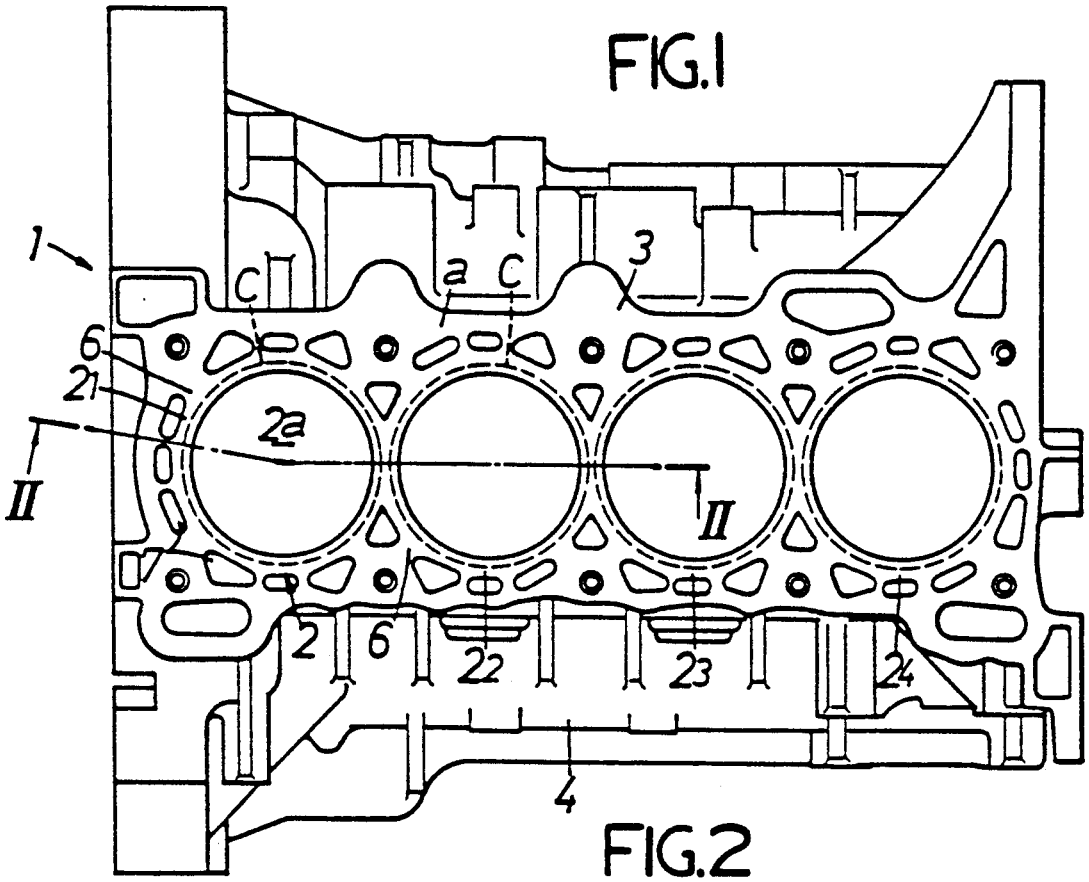
Figure 2:
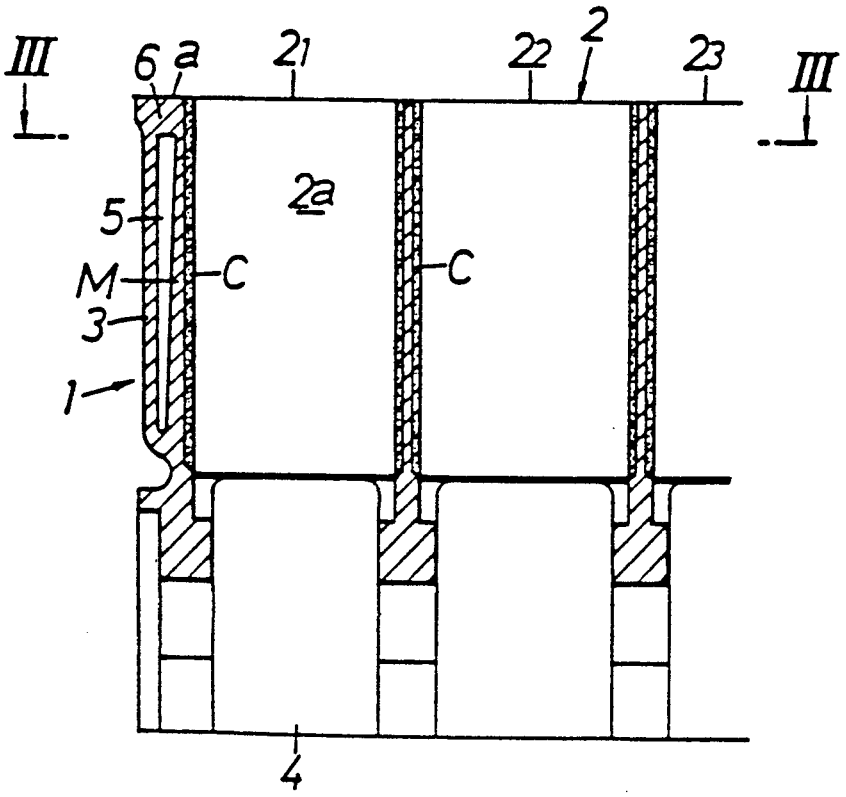
Figure 3:
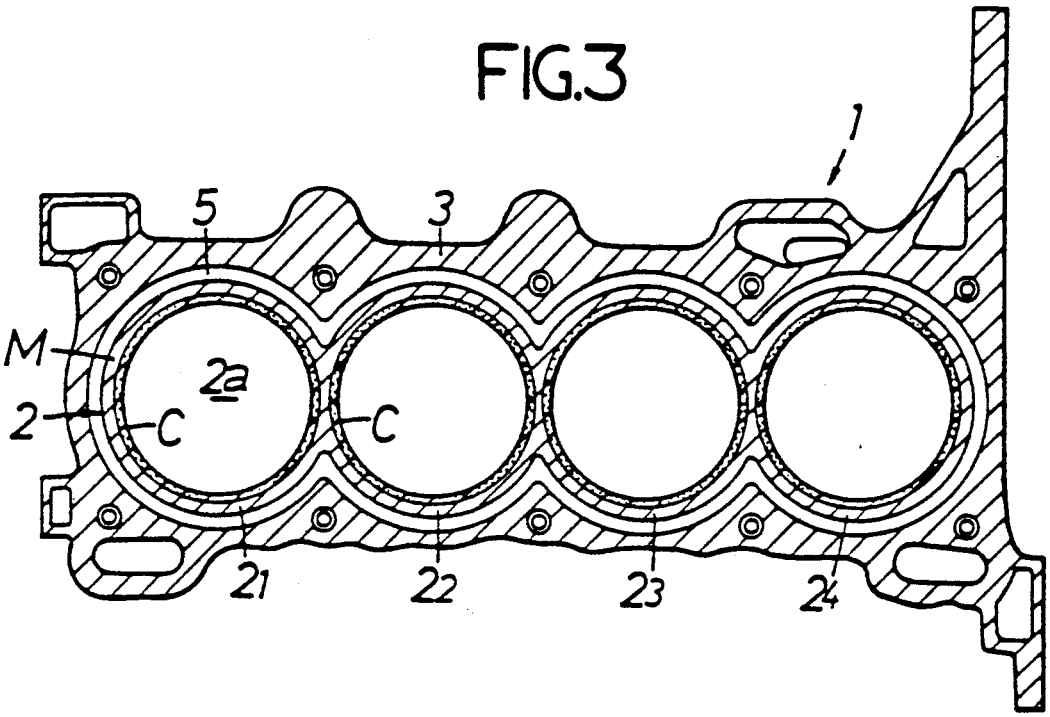
Figure 4:
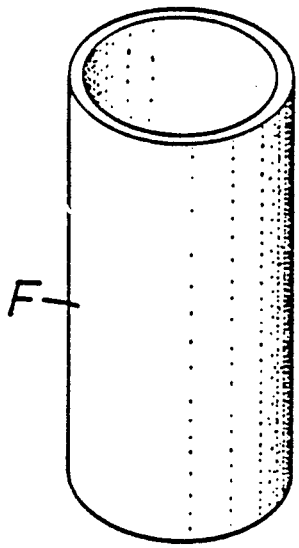
FIG. 4 is a perspective view of a fiber molded element.

FIGS. 1 to 3 illustrate a siamese type cylinder block 1 for an internal combustion engine as a fiber-reinforced light alloy member, which is produced from an aluminum alloy as a light alloy in a casting manner. The cylinder block 1 comprises a siamese cylinder barrel portion 2 formed of a plurality of cylinder barrels $2_1$ to $2_4$ interconnected and each having a cylinder bore 2*a*, an outer cylinder block wall 3 surrounding the cylinder barrel portion, and a crank case 4 connected to the outer cylinder block wall 3. Between the siamese cylinder barrel portion 2 and the outer cylinder block wall 3, there is a water jacket 5 to which an outer periphery of the siamese cylinder barrel portion 2 faces. At an end of the water jacket 5 closer to a joined or bonded surface a of a cylinder head, the siamese cylinder barrel portion 2 and the outer cylinder block wall 3 are partially interconnected through a plurality of reinfacing deck portions 6. An opening between the adjacent reinfrocing deck portions 6 serves as a communication port of the water jacket 5 into the cylinder head. Thus, cylinder block 1 is constructed into a so-called closed deck type.

Each of the cylinder barrels $2_1$ to $2_4$ is comprised of a cylindrical fiber-reinforced portion C for reinforcing a wall of the cylinder bore 2*a*, and a cylinder simple aluminum alloy portion M enclosing an outer periphery thereof. The fiber-reinforced portion C is formed of a cylindrical fiber element F molded from a mixed fiber consisting of an alumina-based fiber as a ceramic fiber and a carbon fiber, and an aluminum alloy matrix filled in the cylindrical fiber molded element F under a pressure during casting. Therefore, the mixed fiber is uniformly dispersed in the aluminum alloy matrix.

(i) Alumina-based fiber

The fiber volume fraction of the fiber may be set in a range of 4 to 60%. Setting of the fiber volume fraction in such range allows the fiber content required for fiber reinforcement to be insured.

If the fiber volume fraction is less than 4%, however, the fiber content is insufficient to provide a satisfactory fiber reinforcing power. In addition, the fiber exhibits a notch effect, resulting in a reduced strength of the resultant fiber-reinforced portion C. On the other hand, if the fiber volume fraction excceds 60%, the fiber content is excessive even from the relationship with the carbon fiber, leading to a degraded fillability of the aluminum alloy matrix.

The alumina-based fiber containes particulate matter unfiberized in the production thereof, i.e., necessarily contains shots. The shots having an average particle size of 150 $\mu$ or more exerts an influence on the strength of the fiber-reinforced portion and the like depending upon the content thereof. Thereupon, the content of the shots having an average particle size of 150 $\mu$or more may be set at 4% by weight or less, preferably at 2.5% by weight or less.

Further, silica is contained in an alumina-based fiber such as an alumina fiber, alumina-silica fiber and the like for the purpose of facilitating the fiberization thereof.

In this case, if the silica content is too large, the wettability of the alumina-based fiber with the aluminum alloy is degraded, resulting in a hindered improvement in strength of the resultant fiber reinforced portion C. On the other hand, the silica content is too small, an effect of silica contained is not provided. In addition, the alpha rate of alumina is too high, the alumina-based fiber is brittle because of an increased hardness thereof. When such fiber is used to produce a fiber molded element F, the moldability is degraded and further, the scrach hardness will be increased to promote wearing of a mating member. Moreover, there is a tendency to increasing of falling-off of the alumina-based fiber from the aluminum alloy matrix, and the fallen-off fiber will likewise promote wearing of the mating member. On the other hand, if the alpha rate is too low, the resistance to wear is deteriorated.

Therefore, in order to attain a satisfactory fiber reinforcement of the fiber-reinforced portion C., it is neceaasry to specify the ranges of the silica content and the alpha rate.

From such a viewpoint, the silica content may be set at 25% by weight or less, preferably in a range of 2 to 5% by weight based on the alumina-based fiber, and the alpha rate of alumina may be set at 60% by weight, preferably in a range of 5 to 45% by weight.

Such alumina-based fibers include one commercially available from ICI, Corp. under a trade name of Sunfil, one commercially available from E.I. Du pont de Nemours, and Co. under a trade name of Fiber FP and the like. (ii) Carbon fiber The fiber volume fraction of the carbon fiber may be set in a range of 0.5 to 10%, and for example, one commercially available from Toray Industries, Inc. under a trade name of Toreca T300 (having a heat conductivity of 2.4 cal/cm.s.° C.) is employed. A sizing agent used in the production of a carbon fiber is adhered to the surface of the carbon fiber and may removed by heating to the order of 400° C. in an oven, before the carbon fiber is mixed with an alumina-based fiber.

The carbon fiber has a higher heat conductivity, but has a poor wettability with the aluminum alloy matrix. For this reason, the contact of the carbon fiber with the aluminum alloy matrix at an interface therebetween may be deteriorated and as a result, there is a possibility to bring about a situation that the higher heat conductivity of the carbon fiber cannot be put to efficient practical use at the fiber-reinforced portion C.

According to the present invention, the carbon fiber is uniformly dispersed in the aluminum alloy matrix, with a fiber volume fraction of the carbon fiber being set at a smaller level, namely in a range of 0.5 to 10% as described above. Therefore, it is possible to bring the carbon fiber into satisfactory close contact with the aluminum alloy matrix by a pressing force acting on the aluminum alloy matrix during prduction of the cylinder block 1 in a casting manner, and also to allow the carbon fiber to be strongly embraced into the aluminum alloy matrix during solidificational shrinkage.

Further, the cylinder block 1 after casting production may be subjected to a thermal treatment at a heating temperature of 400° to 500° C. for a heating period of 1 to 10 hours, and this thermal treatment enables an extremely thin layer of reaction product to be formed at an interface between the aluminum alloy matrix and the carbon fiber.

As a result, a good contact of the carbon fiber with the aluminum alloy matrix at the interface therebetween is achieved, and this makes it possible to provide a fiber-reinforced portion C having a good heat conductivity which results from putting the high heat conductivity of the carbon fiber to efficient practical use.

However, if the fiber volume fraction of the carbon fiber exceeds 10%, a pressing force as described above is propagated sufficiently during casting, even because of the relationship with fiber volume fraction of the alumina-based fiber and also, the above-described embracing effect is insufficient during solidification and shrinkage. Thus, the contact of the carbon fiber with the aluminum alloy matrix at the interface therebetween is inferior, leading to less effect of improving the heat conductivity, despite such a larger content of the carbon fiber.

On the other hand, any fiber volume fraction of the carbon fiber less than 10% will result in the heat conductivity of the resultant fiber-reinforced portion C not being improved due to the shortage of the content thereof.

Figure 5:
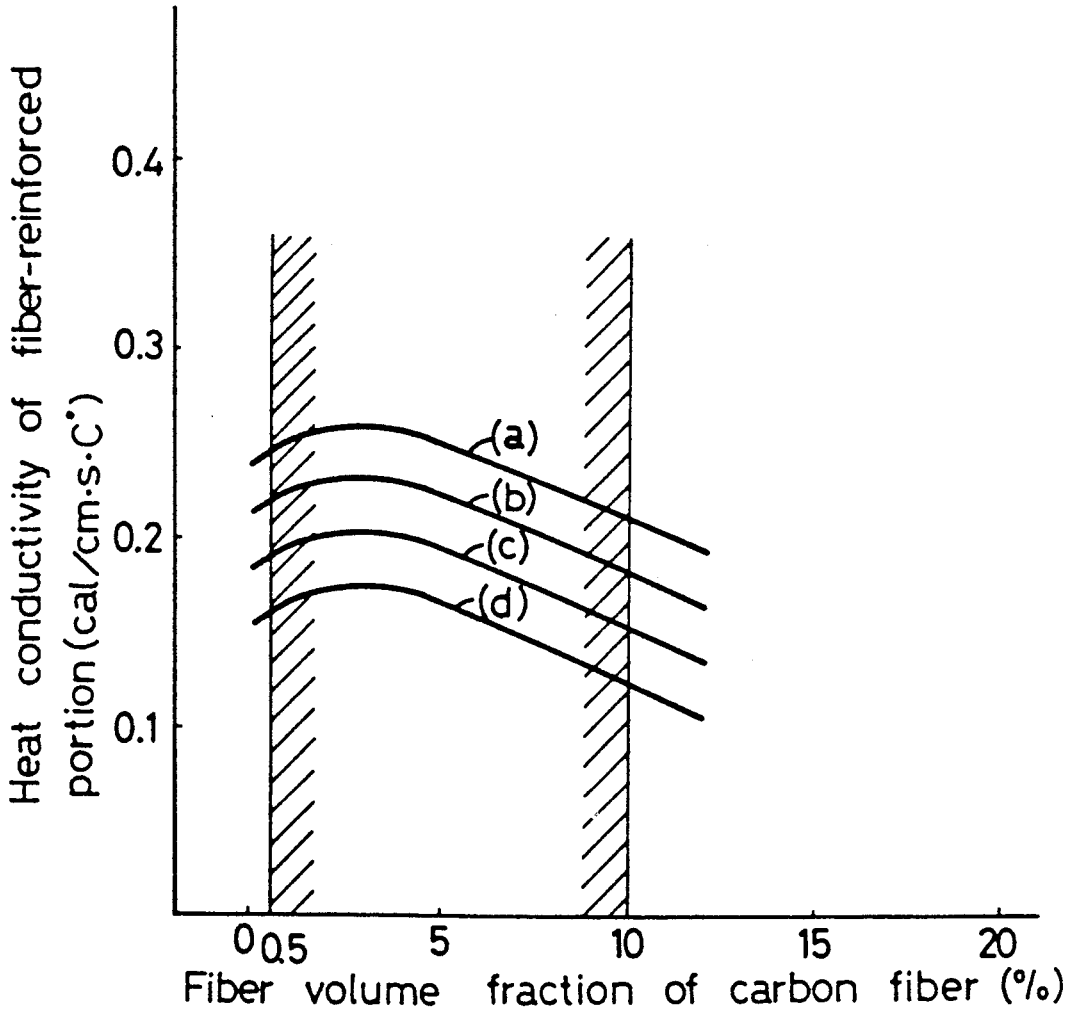
FIG. 5 is a graph illustrating a relationship between the fiber volume fraction of a carbon fiber and the heat conductivity of a fiber-reinforced portion.

FIG. 5 illustrated the heat conductivities of the fiber-reinforced portion C with a given fiber volume fraction of the alumina-based fiber and with different fiber volume fractions of the carbon fiber, wherein the relationships between lines (a) to (d) and the fiber volume fraction of the alumina-based fiber are as given in Table 1.

TABLE 1

| | Fiber volume fraction (%) |
|---|---|
| Line (a) | 12 |
| Line (b) | 15 |
| Line (c) | 19 |
| Line (d) | 21 |

As apparent from FIG. 5, for each of the fiber volume fraction fo the alumina-based fiber, if the fiber volume fraction of the carbon fiber is set in a range of 5 to 10%, the resultant fiber-reinforced portion C had a high heat conductivity.

Figure 6:
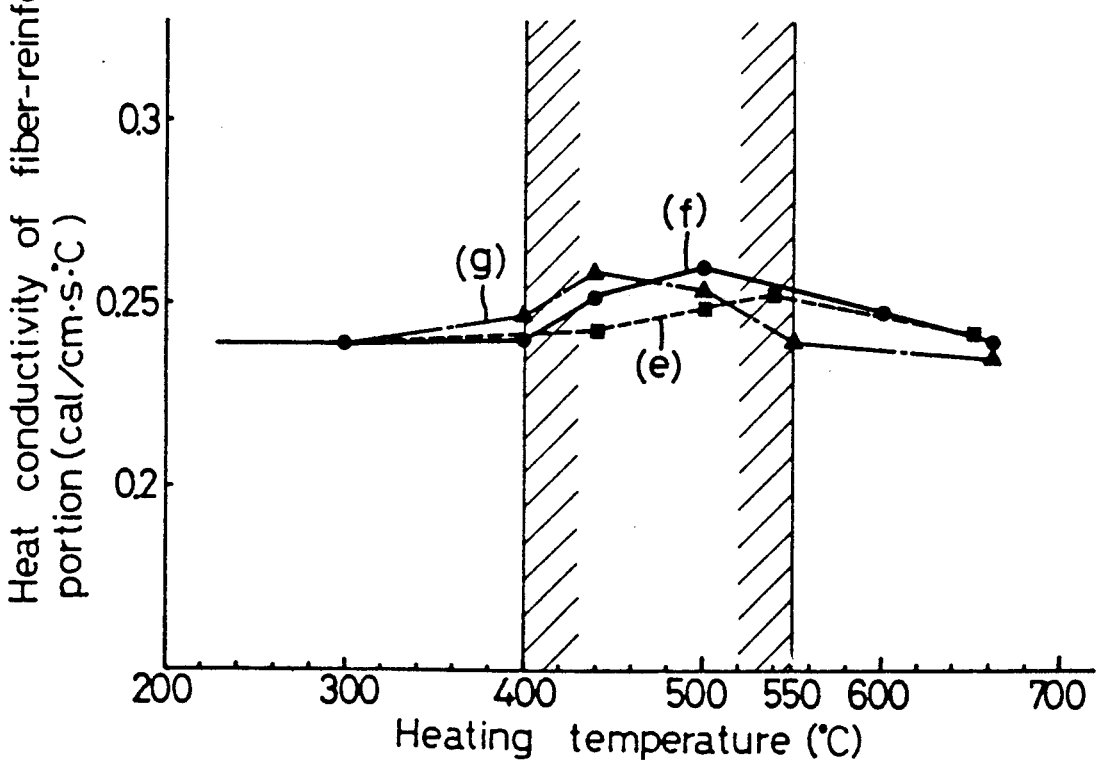
FIG. 6 is a graph illustrating a relationship between the heating temperature and the heat conductivity of the fiber-reinforced portion.

FIG. 6 illustrates a relationship between the heating temperature for thermal treatment and the heat conductivity of the fiber-reinforced portion C. In this case, the fiber volume fraction of the alumina-based fiber in the fiber-reinforced portion C has been set at 12%, and the fiber volume fraction of the carbon fiber has been set at 2.5%. The cylinder block 1 is quenched after heating.

In FIG. 6, a line (e) corresponds to such a relationship when the heating time is one hour; a line (f) corresponds to such a relationship when the heating time is 4 hours, and a line (g) corresponds to such a relationship when the heating time is ten hours.

As apparent from the lines (e) to (g) in FIG. 6, the above-described thermal treatment provides an improvement in heat conductivity.

However, if the heating temperature is lower than 400° C. there is less effect of improving the heat conductivity, whereas if the heating temperature exceeds 550° C., the reaction in the interface between the aluminum alloy matrix and the carbon fiber is too rapid, resulting in a difficult control, and also, a lower melting component in the aluminum alloy is melted, resulting in a reduced strength of the resultant matrix. In addition, the heating time required is one hour at minimum in the aforesaid temperature range. If the heating time exceeds 10 hours, however, the resultant layer of reaction product is of an increased thickness to cause an reduction in heat conductivity improving effect.

Figure 7:
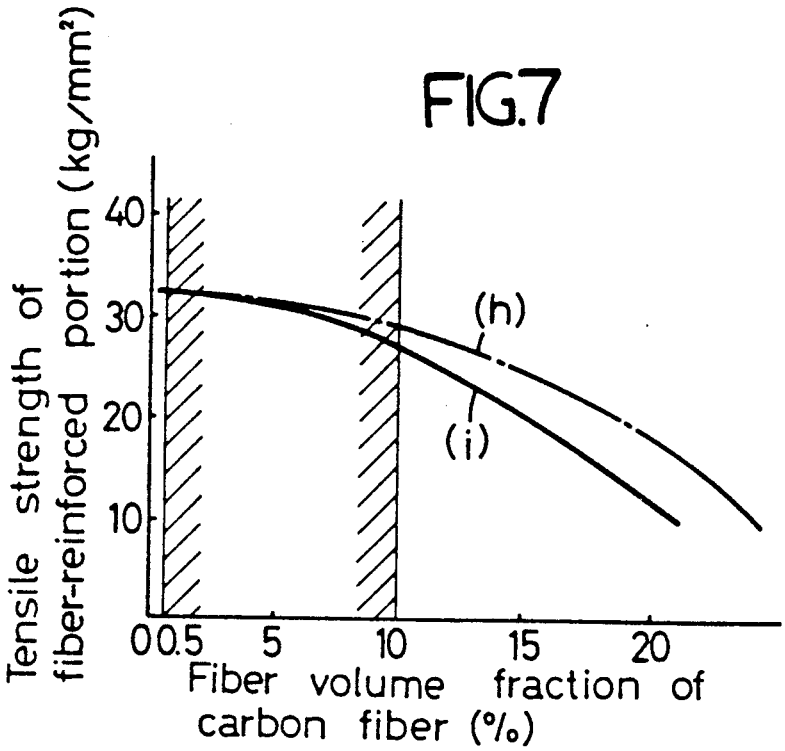
FIG. 7 is a graph illustrating a relationship between the fiber volume fraction of the carbon fiber and the tensile strength of the fiber-reinforced portion.

FIG. 7 illustrates the tensile strength of the fiber-reinforced portion C with a given fiber volume fraction of the alumina-based fiber and with different fiber volume fractions of the carbon fiber. A line (h) corresponds to such a relationship when the fiber volume fraction of the alumina-based fiber has been set at 9%, and a line (i) corresponds to such a relationship when the fiber volume fraction of the alumina-based fiber as been set at 12%

As apparent from FIG. 7, setting of the fiber volume fractin of the carbon fiber in a range of 0.5 to 10% makes it possible to insure the strength of the fiber-reinforced portion C.

In the above-described fiber molded element F, the ratio of the average length of the carbon fiber to the average length of the alumina-based fiber may be set in a range of 0.5 to 1.5, and the aspect ratio of the carbon fiber (l/d wherein l is a length of the fiber and d is a diameter) may be set in a range of 10 to 150.

The use of the alumina-based fiber and the carbon fiber in combination provides a lubricating power of the carbon fiber and hence, is effective in improving the sliding properties of the fiber-reinforced portion C. What should be attended to is to uniformly dispersed both the fibers into the aluminum alloy matrix. To this end, the ratio of the average lengths of the both fibers may be set in a range of 0.5 to 1.5, preferably at 1. Making the diameters of all of the fibers used the same or close to the same is effective for providing a fiber molded element with the both fibers uniformly mixed. To this end, a relationship of the maximum fiber diameter/minimum fiber diameter $<10$ may be established.

Further, to prevent the reduction in strength of the material when the carbon fiber is used in combination, the average aspect ratio may be set in a range of 10 to 150 as described above. If the average aspect ratio is lower than 10, not only the bond strength at the interface between the aluminum alloy matrix and the carbon fiber is smaller, bringing about the promotion of wearing due to falling-off of the carbon fiber from the aluminum alloy matrix, but also the strength resulting from the compounding is not obtained. On the other hand, if the average aspect ratio exceeds 150, not only the carbon fiber is uniformly not dispersed and inferior in resistance to seizure, but also the presence of the carbon fiber develops into a notch effect revealed to bring about a reduction in strength, when a stress in a direction perpendicular to the carbon fiber has been produced in the fiber-reinforced portion C.

Figure 8:
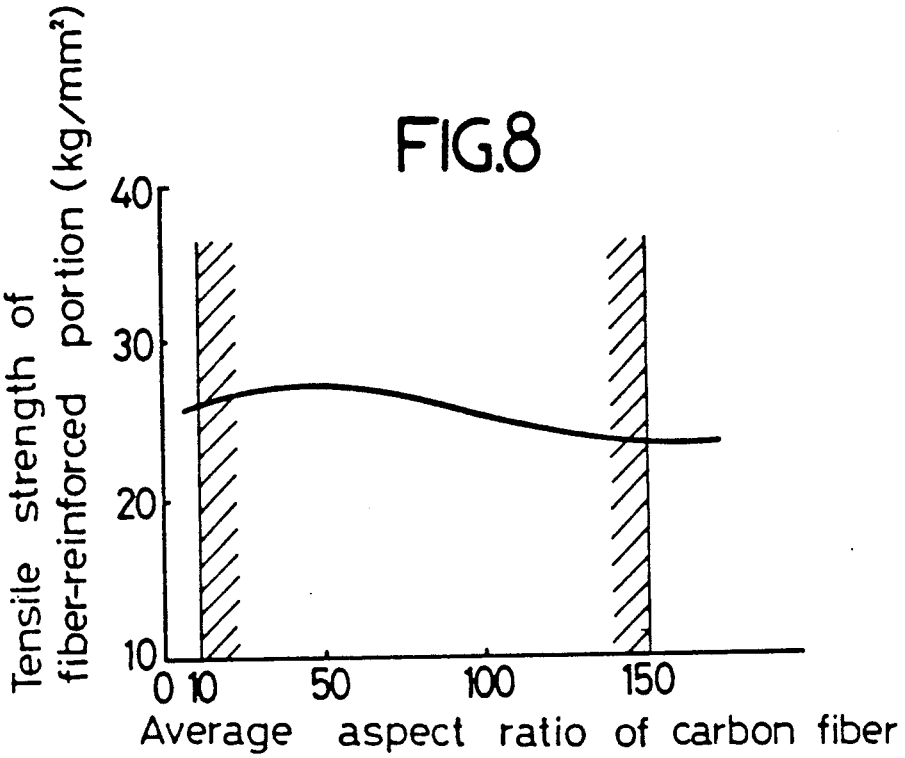
FIG. 8 is a graph illustrating a relationship between the average aspect ratio of the carbon fiber and the tensile strength of the fiber-reinforced portion.

FIG. 8 illustrates a relationship between the average aspect ratio of the carbon fiber and the tensile strength of the fiber-reinforced portion C when the fiber volume fractions of the alumina-based fiber and the carbon fiber have been set at 12% and 9%, respectively. It is apparent from FIG. 8 that setting of the average aspect ratio of the carbon fiber in a range of 10 to 150 makes it possible to provide a fiber-reinforced portion C having a satisfactory strength.

Figure 9:
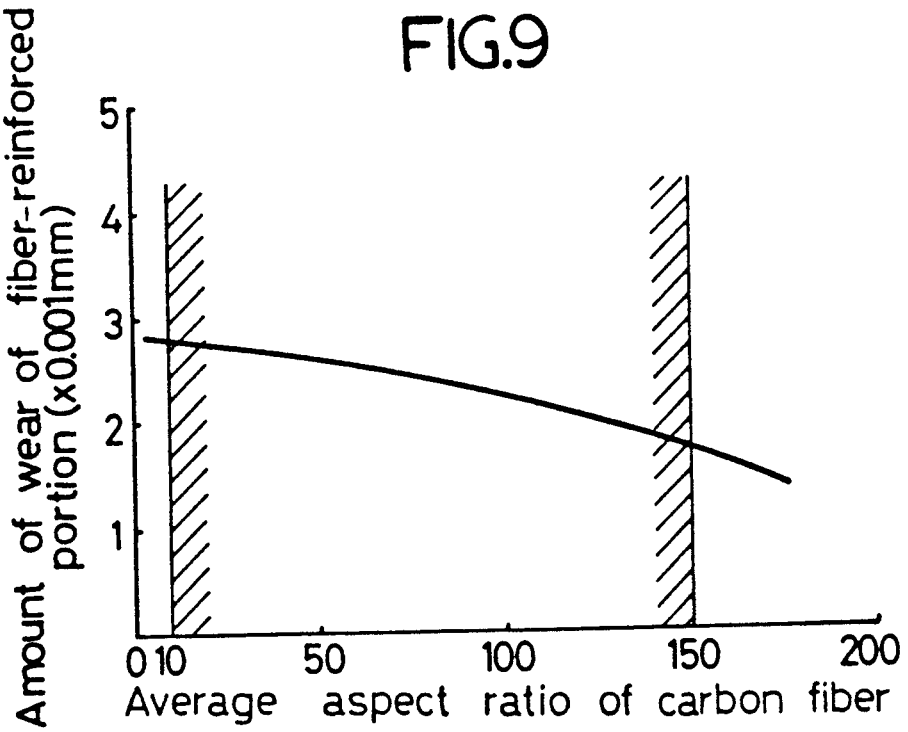
FIG. 9 is a graph illustrating a relationship between the average aspect ratio of the carbon fiber and the amount of fiber-reinforced portion wear.

FIG. 9 illustrates a relationship between the average aspect ratio of the carbon fiber and the tensile strength of the fiber-reinforced portion when the fiber volume fractions of the alumina-based and carbon fibers have been set in the same range as in FIG. 7. It can be seen from FIG. 9 that setting of the average aspect ratio of the carbon fiber in a range of 10 to 150 provide a fiber-reinforced portion C having good sliding properties.

With the carbon fiber used, the more the graphitization rate thereof increases, the higher the lubricity increases, and Young's modulus (E) increases. However, in casting, not only the wettability with the aluminum alloy matrix is reduced but also the extensibility is reduced, so that the carbon fiber is apt to be broken, resulting in a possibility to bring about an reduction in strength of the resultant fiber-reinforced portion C. Further, among pitch type carbon fibers, those having a lower strength are inferior in surface strength and will fail to provide a fiber-reinforced portion C having a required strength.

Accordingly, a carbon fiber having Young's modulus of 20 to 30 t/mm$^2$ is desirable and can be used to produce a fiber-reinforced portion C having a required strength..

Figure 10:
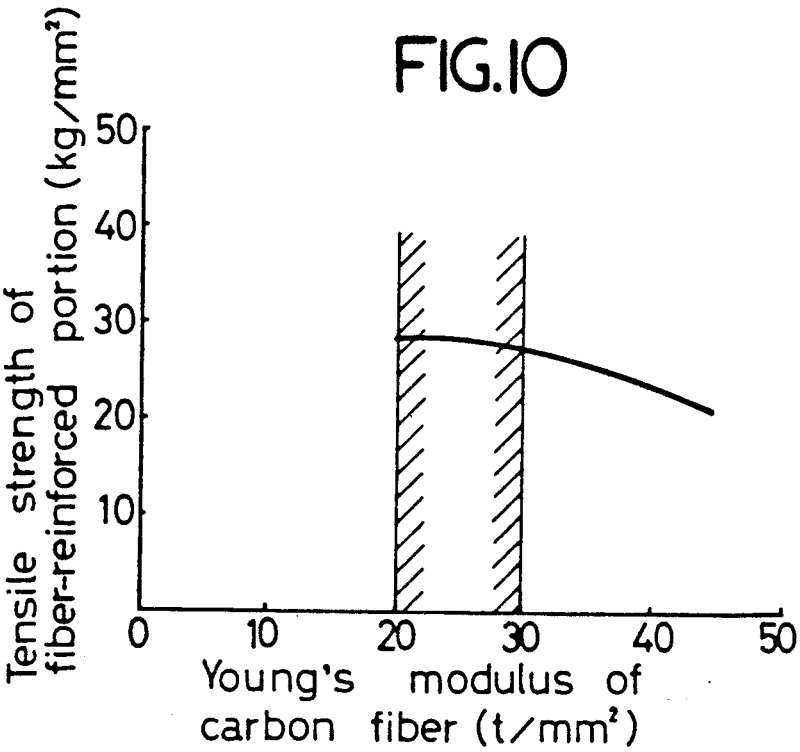
FIG. 10 is a graph illustrating a relationship between the Young's modulus of the carbon fiber and the tensile strength of the fiber-reinforced portion.

FIG. 10 illustrates a relationship between Young's modulus of the carbon fiber and the tensile strength of the fiber-reinforced portion C when the fiber volume fractions of the alumina-based and carbon fibers have been set at 12% and 9%, respectively. As apparent from FIG. 10, if the Young's modulus of the carbon fiber is set in a range of 20 to 30 t/mm$^2$, it is possible to produce a fiber-reinforced portion C having a satisfactory strength.

A carbon fiber having an average diameter of 6 to 8 $\mu$m and an average length of 100 to 200 $\mu$m is preferred. In this case, filaments in the carbon fiber having a length of 20 $\mu$m or less are set at a content of 15% by weight or less, and filaments having 300 μm or more are set at a content of 9% by weight or less.

(iii) Aluminum alloy

Aluminum alloys which may be used are those containing silica. In this case, the larger the Si content is, the higher the heat conductivity of the aluminum alloy increases. With this viewpoint taken into consideration, the Si content may be of 5.0% by weight or more, preferably in a range of 8.5 to 12.0. If Si content exceeds 14.0% by weight, however, the aluminum alloy is of a hyper-eutectic structure, and initial crystal Si is apt to be crystallized. This gives rise to a reduction in strength and the like.

One example of aluminum alloys of such a type is one having a composition as given in Table II.

TABLE II

| Chemical constituents (% by weight) | | | | | |
|---|---|---|---|---|---|
| Cu | Si | Mg | Zn | Fe | Al |
| 1.5–4.5 | 5.0–14.0 | 0.35 or less | 1.0 or less | 0.5–0.7 | balance |

Production of a cylinder block 1 as described above in a casting manner may be carried out using a technique of preheating a mold, placing a preheated fiber molded element into the mold, pouring a molten metal into the mold and solidifying the molten metal under a pressurized condition after a lapse of a predetermined time.

If the molten metal is left to stand for a predetermined period of time prior to pressurization as described above, alpha initial crystal having a smaller Si content is precipitated in an aluminum alloy simply portion M while the molten metal is left to stand. If the molten metal is then pressurized, the molten metal portion having a relatively large Si content is filled into the fiber molded element F. Thus, in a resultant fiber-reinforced portion C, the initial crystal Si content (% by weight) is larger than that of the aluminum alloy simple portion M.

If the initial crystal of a larger Si content is formed in the fiber-reinforced portion C in this manner, there are obtained an increased strength thereof and good sliding properties. On the other hand, the initial crystal Si content is smaller in the aluminum alloy simple portion M and hence, the increasing of the hardness thereof is suppressed to provide a good cutting property.

In order to provide the aforesaid effect, the initial crystal Si content of the fiber-reinforced portion C may be set at a level 1 to 4 times, preferably 1.2 to 2.0 times that of the aluminum alloy simple portion M. Such a situation can be readily realized by adjustment of the temperature for preheating the fiber molded element F and of the time for which the molten metal is left to stand prior to pressurization.

The average particle size of the initial crystal Si in the fiber-reinforced portion C may be set at a level less than the average diameter of the alumina-based fiber. Such a control can be accomplished by simply adjusting the temperature for preheating the fiber molded element to adjust the rate and time of solidification of the molten metal in the fiber molded element and the surroundings thereof.

If the average particle size of the initial crystal Si is specified in the above manner, the initial crystal Si is finely divided, thereby allowing an improvement in strength of the fiber-reinforced portion C and an improvement in sliding properties with the falling-off of the initial crystal Si being suppressed to the utmost.

It should be noted that a magnesium alloy can be used as a light alloy. In addition, the carbon fibers which may be used in the present invention include those having a layer of ceramic coating thereon and those having a layer of metal coating. With the latter, there is obtained a good wettability of the carbon fiber with a light alloy matrix and hence, an effect of improving the heat conductivity is revealed in such member, even if the carbon fiber has a fiber volume fraction lower than the above-described range. Further, an extruding method can also be applied to provide a light alloy member. Even in this case, the upper limit of the fiber volume fraction of the ceramic fiber is limited to 60%. This reason is because the mixed fiber cannot be uniformly dispersed in the light alloy matrix, if the fiber volume fraction exceeds 60%.

What is claimed is:

1. A fiber-reinforced light alloy member excellent in heat conductivity and sliding properties, comprising a mixed fiber uniformly dispersed in a light alloy matrix, said mixed fiber consisting of a ceramic fiber having a fiber volume fraction of 4 to 60% and a carbon fiber having a fiber volume fraction of 0.5 to 10% and a thin layer of reaction product generated at an interface between the carbon fiber and the light alloy matrix by a thermal treatment at a heating temperature of 400° to 450° C.

2. A fiber-reinforced light alloy member according to claim 1, wherein the carbon fiber has a Young's modulus of 20 to 30 t/mm$^2$ and an average aspect ratio of 10 to 150.

* * * * *